US006926318B2

(12) United States Patent
Oxley

(10) Patent No.: US 6,926,318 B2
(45) Date of Patent: Aug. 9, 2005

(54) FIELD CONFIGURABLE ELECTRIC STRIKE FOR EXIT DEVICES

(75) Inventor: Randall C. Oxley, Belmont, MA (US)

(73) Assignee: Rutherford Controls Int'l. Corp., Ontario (CA)

( * ) Notice: Subject to any disclaimer, the term of this patent is extended or adjusted under 35 U.S.C. 154(b) by 0 days.

(21) Appl. No.: 10/639,839

(22) Filed: Aug. 12, 2003

(65) Prior Publication Data

US 2004/0032130 A1 Feb. 19, 2004

Related U.S. Application Data

(60) Provisional application No. 60/402,748, filed on Aug. 12, 2002.

(51) Int. Cl.[7] ..... E05B 15/02
(52) U.S. Cl. ..... 292/341.16; 292/201
(58) Field of Search ..... 292/341.16, 201, 292/DIG. 29

(56) References Cited

U.S. PATENT DOCUMENTS

| | | | | | |
|---|---|---|---|---|---|
| 3,640,560 | A | | 2/1972 | Zawadzki et al. | 292/341.16 |
| 4,211,443 | A | * | 7/1980 | Butts et al. | 292/341.16 |
| 4,984,835 | A | | 1/1991 | Vadacchino et al. | 292/341.16 |
| 5,072,973 | A | * | 12/1991 | Gudgel et al. | 292/55 |
| 5,076,625 | A | * | 12/1991 | Oxley | 292/341.16 |
| 5,127,691 | A | | 7/1992 | Herron et al. | 292/341.16 |
| 5,219,196 | A | | 6/1993 | Luker | 292/341.16 |
| 5,484,180 | A | | 1/1996 | Helmar | 292/341.16 |
| 5,490,699 | A | | 2/1996 | Uyeda | 292/341.16 |
| 5,511,839 | A | | 4/1996 | Fuss et al. | 292/341.18 |
| 5,788,295 | A | | 8/1998 | Fuss et al. | 292/341.16 |
| 5,915,766 | A | * | 6/1999 | Baumeister et al. | 292/341.15 |
| 5,924,750 | A | | 7/1999 | Fuss et al. | 292/201 |
| 5,934,720 | A | | 8/1999 | Karalius | 292/341.16 |
| 6,082,791 | A | | 7/2000 | Frolov et al. | 292/341.16 |
| 6,299,225 | B1 | | 10/2001 | Chang | 292/341.16 |
| 6,595,563 | B2 | * | 7/2003 | Kiernan | 292/341.16 |
| 6,595,564 | B1 | * | 7/2003 | Hanchett et al. | 292/341.16 |
| 2002/0029526 | A1 | | 3/2002 | Kieman | 49/503 |

FOREIGN PATENT DOCUMENTS

| | | | |
|---|---|---|---|
| GB | 2280218 | 1/1995 | E05B/47/00 |
| WO | WO 86/02690 | 5/1986 | E05B/47/06 |

* cited by examiner

*Primary Examiner*—Gary Estremsky
(74) *Attorney, Agent, or Firm*—Erik B. Cherdak; Arent Fox PLLC

(57) ABSTRACT

This electric strike mechanism has a housing, a keeper pivotally mounted in the housing, at least one locking element pivotally mounted within the housing, for pivoting between a first position where the keeper is prevented from pivoting, and a second position where the keeper is permitted to pivot so that the door can be opened, a solenoid connected to each locking element via an actuation mechanism to move each locking element when the solenoid is energized, and a spring biasing the solenoid towards a non-actuated position. The actuation mechanism may be installed in one of two orientations, namely a first (fail-secure) orientation wherein the locking element is in its first position when the solenoid is not energized and wherein energizing the solenoid moves the locking element to the second position, and a second (fail-safe) orientation wherein the locking element is in the second position when the solenoid is not energized and wherein energizing the solenoid moves said locking element to the first position.

4 Claims, 15 Drawing Sheets

SIDE VIEW
LOCKED POSITION

SIDE VIEW
UNLOCKED POSITION

BOTTOM VIEW
LOCKED POSITION

BOTTOM VIEW
UNLOCKED POSITION

PRIOR DEVICE

PRIOR DEVICE

FIELD CONFIGURABLE ELECTRIC STRIKE FOR EXIT DEVICES

REFERENCE TO RELATED APPLICATION

This is a formal application based on and claiming the benefit of U.S. provisional patent application No. 60/402,748, filed Aug. 12, 2002.

BACKGROUND OF THE INVENTION

This invention relates to an electric strike that is small enough to be used in multiple applications and can be configured in the field for fail-safe or fail-secure operation.

The field of electrically operated strikes is filled with a multitude of devices, which essentially do the same thing: they release a latch that extends into the body of the strike so as to open the door that contains the latch. They commonly use a solenoid which, through some mechanical linkage, will release the keeper holding the latch and then return to its locked condition after the latch is released. There are very few electric strikes whose keeper extends into a latch contained within the door and, upon energizing, not only rotates out of the latch, but also remains in its rotated condition until the door closes and the latch returns the keeper to its locked condition. For reference there are two such devices: an electric strike disclosed in U.S. Pat. No. 5,076,625 issued to Oxley on Dec. 31, 1991; and an electric strike called the Panicloc (trademark), formerly manufactured by SDC, Inc., of Westlake Village, Calif., USA.

The present invention is designed to control the most widely used concealed vertical rod exit devices that come as standard equipment on aluminum storefront type doors such as those made by the Dor-O-Matic Company, of Harwood Heights, Ill., USA. This exit device has been the largest selling exit device in the world, and yet, it has been the most difficult to adapt to electronic access control systems because it features a unique latching system. A U-shaped latch is mounted in the top of the door and does not extend beyond the outer edge of the door. A pin, which is mounted on the header, engages the latch. When the exit device is operated from the inside, the latch releases by the movement of the push bar, and the motion of the opening door forces the latch to pivot via the pin on the header. The pin then passes through a slot in the inside skin of the door as it opens. When the door closes, the header pin contacts the latch and rotates it back to its vertical (locked) position. As computerized access control becomes more necessary, more of these OEM devices will need to be controlled. The present invention provides a cost-effective solution to the drawbacks of the prior art devices. Additionally, since the adoption in the United States of the Americans with Disabilities Act, and similar legislation in other countries, a great many more of these existing doors need to be retrofitted with automatic door openers that require an electric strike to release the door.

The existing device referenced is the electric strike identified by U.S. Pat. No. 5,076,625. It features a keeper shaped with a lobe that extends into the U-shaped latch and swings out of the way when the strike is energized and the door is opened. That strike, in its preferred embodiment, is built on an existing electric strike body available from an established manufacturer to take advantage of a proven "platform" upon which to build. This was done to speed the product to market and avoid the costly task of making the strike from scratch. The "platform" strike is asymmetrically designed relative to where the keeper is placed in the body of the strike. This characteristic limits the useful application of the strike to include only a few possible applications. Additionally, the strike malfunctions after a particular combination of events occurs. When an authorized individual gains access, the strike is energized by the access control system. The motion of the door opening rotates the keeper out of the latch. Normally, the door closes, rotating the keeper back and re-locking it after the person has entered. If, however, the panic bar is pushed before the door closes, (for example if another person exits just after the entry is achieved), the latch rotates toward the inside of the door and hits the keeper as it tries to rotate back to its closed position. This causes an interference that keeps the door from closing and locking. There are also difficulties one encounters while installing the strike. The design of the platform strike situates the body of the strike behind the outside edge of the doorstop. Proper installation requires the installer to measure over the door stop "rib" in the header and lay out lines for the cutout needed to mount the strike. This proves to be difficult for installers and many are intimidated enough to not use the product.

Finally, the platform strike was never intended by its manufacturer to be a "finished" piece: it is always attached to a finished plate of a different shape. It takes a great deal of work to get the platform strike to look finished, and even then, the strike can only be made in two architectural finishes.

The other device, i.e. the Panicloc device, is an adaptation of a fail-safe solenoid powered bolt lock which mounts in a door header. It has a bolt that extends into a pocket installed in the top of a door by the application of electric current through a solenoid via a 90-degree lever. The Panicloc device utilizes the solenoid and lever system with a metal bolt that has a bevel on one side which extends into the latch. This device is not currently being made because it doesn't work well in this application.

There is one other device that is used to electronically control these doors, and that is the magnetic lock. However, since an electromagnetic lock requires that the mechanical exit device be removed from the door, this is not a preferred solution. Normal egress is disrupted. Normal access by key is lost. Additionally, in the event of a power failure, the door with a magnetic lock will be totally unlocked and unsecured. Many Fire Chiefs and Building Inspectors do not allow magnetic locks to be used on exit doors.

There is thus a need for an electric strike which can accommodate more mounting applications and is easier to install. It is desirable for the strike to be configured easily by the user to operate in either the "fail-safe" or the "fail-secure" mode.

SUMMARY OF THE INVENTION

In view of the preceding, the invention provides an electric strike mechanism having a housing, a keeper pivotally mounted in the housing, at least one locking element pivotally mounted within the housing, for pivoting between a first position where the keeper is prevented from pivoting, and a second position where the keeper is permitted to pivot so that the door can be opened, a solenoid connected to each locking element via an actuation means to move each locking element when the solenoid is energized, and a spring biasing the solenoid towards a non-actuated position. The actuation means may be installed in one of two orientations, namely a first orientation wherein the locking element is in its first position when the solenoid is not energized and wherein energizing the solenoid moves the locking element to the second position, and a second orientation wherein the locking element is in the second position when the solenoid is not energized and wherein energizing the solenoid moves said locking element to the first position.

In the preferred embodiment, the actuation means includes two locking bolts, and energizing the solenoid either moves the locking bolts behind the keeper to lock the door (fail-safe mode of installation), or away from the keeper to unlock the door (fail-secure mode of installation).

Further details of the invention will be described or will become apparent during the course of the following detailed description.

Advantages of the invention include: its size; its ability to be field configured for fail-safe and fail-secure operation; its ease of installation in any application; and its keeper. The keeper attends to the rotation of the aforementioned Dor-O-Matic (trademark) latch back to its locked position as it is itself rotated back to its own locking position. This eliminates the jamming problem that plagues prior devices. The new strike is smaller and mounts in required applications without modification. The strike is designed to simplify installation: all necessary cutting is done forward of the door stop rib. This satisfies a major complaint of prior device installers who have difficulty measuring and cutting over and through the doorstop. The strike, when installed, is to be adorned by a finished trim plate. These trim plates can be easily and cheaply stamped out of sheet metal in any architectural finish requested. This solves the problem of having to sand or paint the prior device's strike body in its entirety.

The strike also features the ability to change its mode of operation, even at the time of installation, without the need of extra parts or expenditure. It is not possible to reconfigure the prior strike in the field. All the configuring has to be done at the time that the order is placed for manufacture and consequently, limits the usefulness of each strike to a single type of application. This causes a lot of returns, delays, and unhappy customers. It also requires distributors to stock an extensive variety of strikes to fill customer orders. There is no way to take a prior strike and change it to suit a rush order for a differently configured strike. This causes problems with distributors who don't want to stock every possible variation. This results in many disruptions in manufacturing's production cycle in order to produce a "special" order in a rush situation.

The invention addresses these problems for the manufacturer, distributor, and installer. It permits one strike body to be used in any application just by selecting the correctly finished trim plate to match the order. Because the trim plates are inexpensive, the distributor and installer can stock a variety of them at a comparatively minimal cost. This allows the installer to carry fewer strikes to the job-site, and have fewer return trips per job. This also allows the distributor to sell a greater volume of strikes with less per piece special attention required filling orders. This also allows the manufacturer to benefit from fewer "rush order" interruptions to their normal production cycle. All of these features are a distinct improvement over prior devices. All of these features result in a more volume and profits for the manufacturer, distributor, and the installer.

Since the mechanism developed for this strike is relatively compact, it can be used in other embodiments, such as a rim panic strike, a 161 prep strike, and an ANSI standard size strike, among others. Installation of a typical rim panic strike requires cutting out a portion of the hollow metal door jamb to accommodate the mechanism or body of the strike, and often the door jambs are concrete filled. The concept of a flush mounted rim strike for an exit device is relatively new, but not novel. Prior patented rim strikes are generally larger, thicker, and longer than the strikes they are replacing. The invention makes possible a rim panic strike that can be very flat and small enough to replace the standard typical roller strike that comes as standard equipment for most exit devices. This results in a strike that will mount, using the same mounting screw holes as the non-electric roller strike, and that can be installed in matter of seconds, without any cutting, by anyone who can use a screwdriver.

The invention can be made small enough to fit the old standard jamb cutout (161 prep) that is 2¾"×1⅛". This configuration, also referred to as the "T" strike cutout, is used widely in residential applications and almost exclusively in the modular office wall partition systems used today. Since the solenoid is housed within the small strike body, the normal extra depth cutout is not required. This saves labor time and expense during installation, and also preserves the structural integrity of the door jamb. This is especially important in residential applications that feature wooden doorjambs. In most electric strike installations, it is necessary to cut away the doorjamb to permit the latch a means of passage when opening the door. This is labor intensive, and can be unsightly in residential and commercial applications where there are fancy wooden or steel door casings that have to be cut out. When this new strike is installed with the accompanying special faceplate, any cutout for a raceway is not necessary. The small strike and ANSI embodiments will use a specially designed face plate that features a ramp for the latch to travel up and over the lip of the face plate without necessitating any further cutting. This ramp has a special shape that accommodates the auxiliary latch, which normally serves to block the latch from being "ramped" back into the door. This special faceplate will benefit the user in at least three ways. It will save time and expense of labor normally needed for installation of the strike. It will improve the appearance of the strike in the doorjamb and preserve the esthetic integrity of the existing door casing. Finally, it will improve the security of the door latch and lock by eliminating the need for a large "raceway" for the latch. Raceways usually serve to provide an opportunity for tool attack by anyone seeking to pry back the latch to bypass the door locking system.

BRIEF DESCRIPTION OF THE DRAWINGS

The invention will now be described in detail, with reference to the accompanying drawings of the preferred embodiment by way of example only, in which.

DETAILED DESCRIPTION OF THE INVENTION

Figure 1:
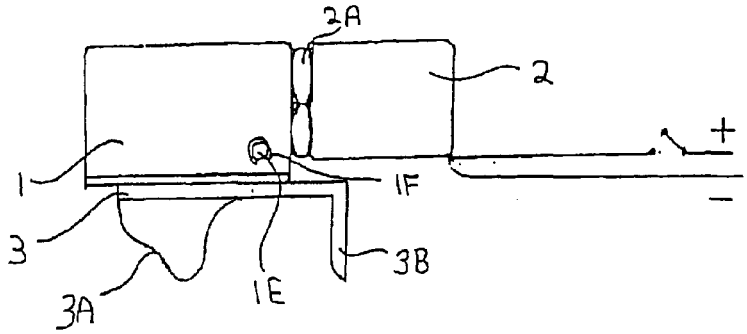
FIG. 1 is a side view, at rest in its locked position, of one embodiment of the invention.

FIG. 1 is a side schematic view of an electric strike, according to the present invention, as it would be typically mounted in a door header or jamb. This figure shows the external view of the assembly of parts, in its preferred embodiment, comprised of the strike body 1, a solenoid 2 which is threaded into the body 1 and fastened into place by a lock nut 2A. A keeper 3 which rotates about an axle 1E and extends below the body 1 so as to engage a door latch or plate in the top or side of a door. The axle passes through the strike body 1 and is centered therein by retainer clips 1F at either end. The view also shows the reverse contour 3A and the relocking lever 3B features of the keeper.

Figure 2:
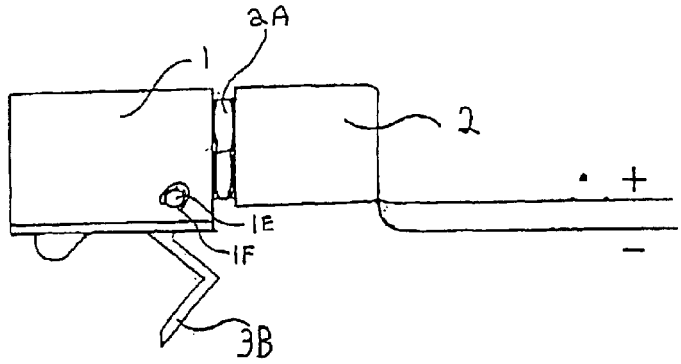
FIG. 2 is a side view, at rest in its unlocked position, of the aforementioned embodiment of the invention.

FIG. 2 shows the strike of FIG. 1 with the keeper 3 (which is spring biased toward the released position) in the released position.

Figure 3:
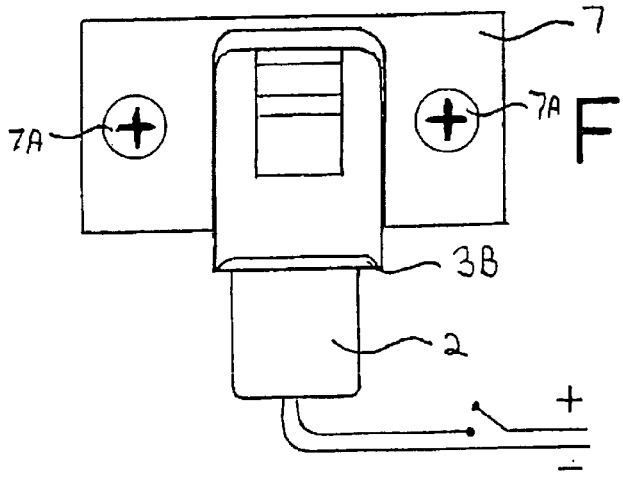
FIG. 3 is a bottom view, at rest in its locked position, with the finished cover plate and screws.

FIG. 3 illustrates the preferred embodiment from a bottom view in the locked position.

Figure 4:
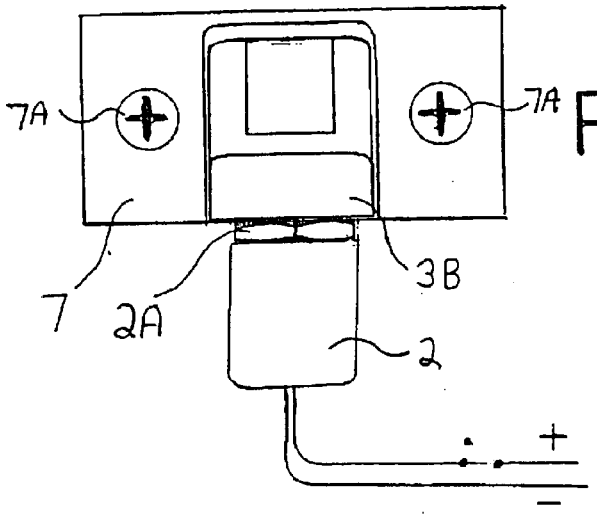
FIG. 4 is a bottom view of the electric strike of FIG. 3 with the keeper rotated to its unlocked or released position.

FIG. 4 shows the strike of FIG. 3 in the unlocked position.

Figure 5:
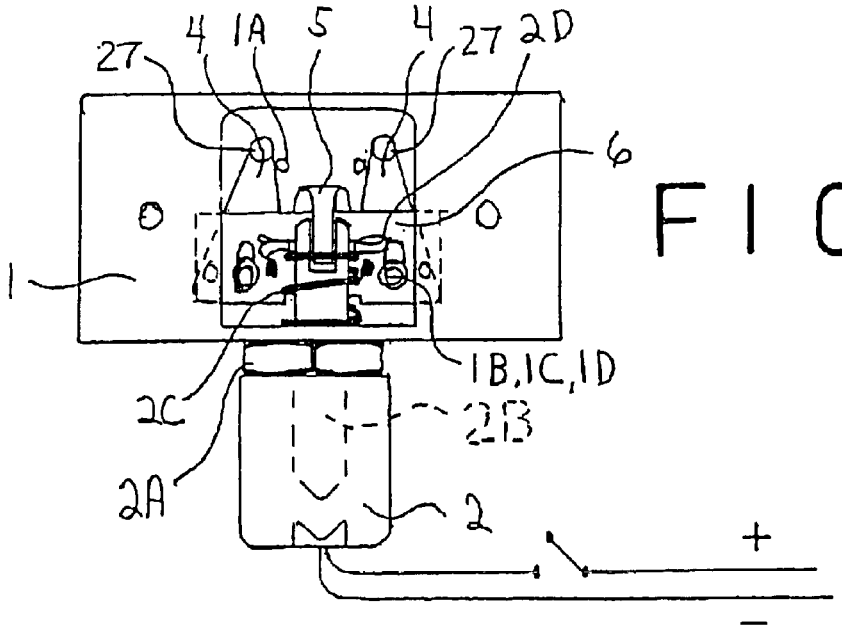
FIG. 5 is a bottom view of the electric strike of FIG. 3 with the keeper and cover plate removed to show the underlying mechanism at rest in the locked position of the fail-secure configuration.

FIG. 5 shows a cutaway view of the strike of FIG. 4 in the locked position. The body 1 of the strike receives the solenoid 2, which is held in place by locking nut 2A. Internal to and extending out of the solenoid into the lock body, the plunger 2B captures a return spring 2C behind a pin 2D connecting the plunger 2B to the actuator 5. The actuator 5 connects to the actuator plate 6 by means of two locator pins 20 (see FIG. 15) engaging holes 21 in the actuator plate and transfers any linear motion of plunger 2B to the actuator plate 6. The actuator plate 6 features two parallel slots 22 (see FIG. 15) which slide over a larger circumference of the pivots 1B and underneath washers 1C and retaining clips 1D. Actuator plate 6 has two sets of driver pins: one set 24 on the top placed inside and equidistant of the pivot slots; and one set 24A on the bottom placed outside and equidistant of the pivot slots. These pins engage inner or outer holes 25 or 25A respectively in locking bolt plates 4. Each locking bolt plate pivots about a pivot 1B mounted in the housing and extending through a pivot hole 26 (see FIG. 15). Sliding motion of the actuator plate 6 is transferred to the locking bolt plates via the driver pins 24 or 24A, producing equal and opposite moments of torque on the locking bolt plates. As shown in FIG. 5, locking elements such as locking bolts 27 extend from the locking bolt plates and rest against a stop means 1A toward the center of the strike body 1.

Figure 6:
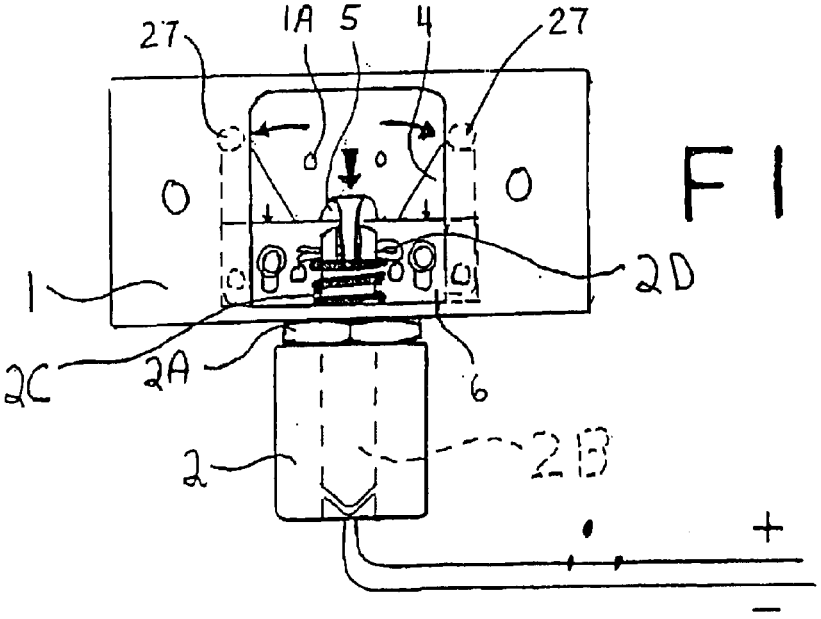
FIG. 6 is a bottom view of the electric strike of FIG. 5 in the energized, unlocked position of the fail-secure configuration.

FIG. 6 illustrates the invention when an electric current is applied to the solenoid 2 to unlock the keeper 3. As the electromagnetic force urges the plunger into the body of the solenoid, it compresses the return spring 2C. After the current is stopped, the mechanism is returned to its prior state by this spring as it decompresses in the first condition (FIG. 5) the locking bolts 4 are at rest at the center of the strike body 1 under the keeper 3. When the solenoid is energized (FIG. 6), the locking bolts are rotated so as to move toward and beyond the edges of the keeper 3, to the sides of the body 1, allowing the keeper 3 to rotate to its unlocked position. When the keeper 3 is rotated back to its locked position, and the solenoid 2 is not energized, the locking bolts 4 rotate back toward each other to the center of the strike body 1. This is the fail-secure configuration. This configuration is defined as the strike being locked when no power is applied to the solenoid.

Figure 7:
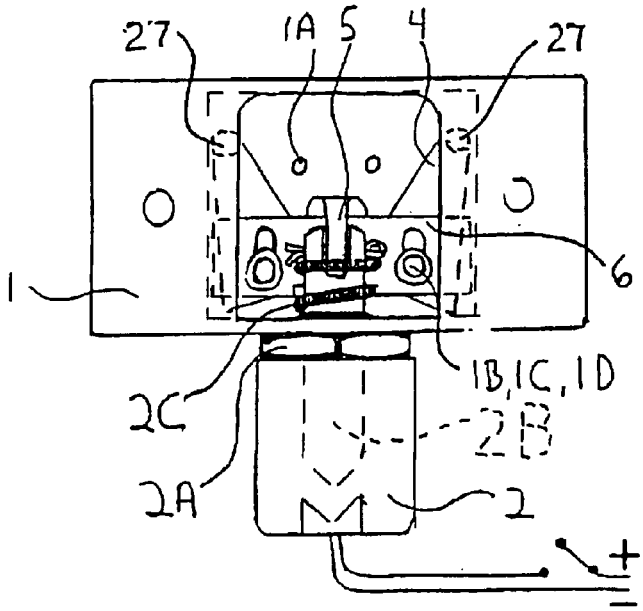
FIG. 7 is a bottom view of the electric strike of FIG. 5 at rest in the unlocked position of the fail-safe configuration.
Figure 8:
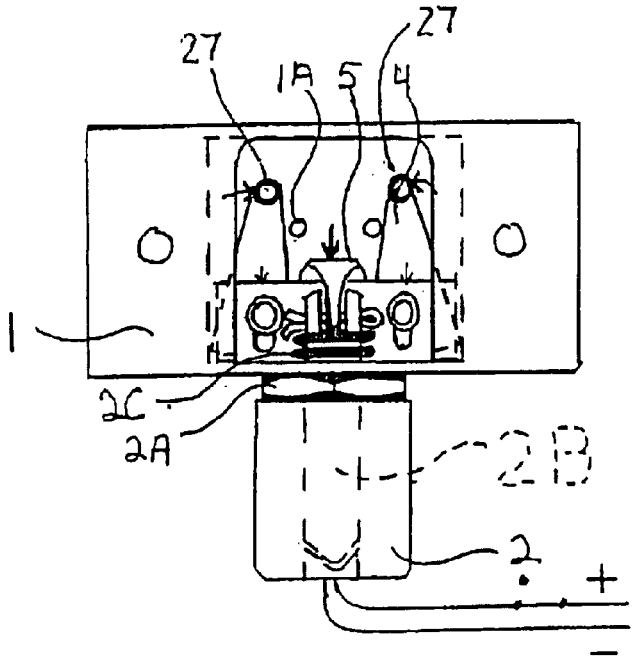
FIG. 8 is a bottom view of the electric strike of FIG. 5 in the energized, locked position of the fail-safe configuration.

In the second condition (FIG. 7), the actuator plate is flipped over and the locking bolts 4 are at rest at the outer edges of the strike body 1. When the solenoid is energized (FIG. 8), the locking bolts 4 are rotated so as to move from the sides of the strike body toward each other and stop at the center of the body 1 which position prevents the keeper from releasing and rotating. When the solenoid is de-energized, the locking bolts 4 rotate back toward the edges of the body 1. This then allows the keeper 3 to rotate. This is the fail-safe configuration. This configuration is defined as the strike being unlocked when no power is applied to the solenoid.

Figure 9:
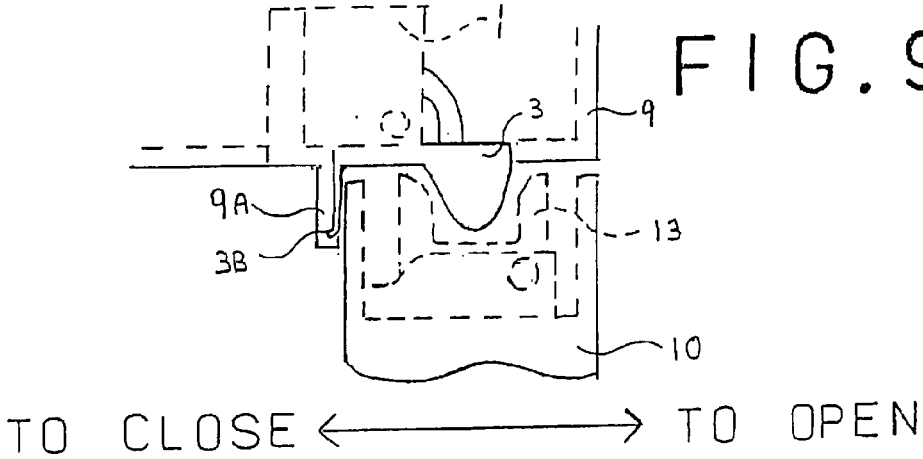
FIG. 9 (prior art) is a side view, partially in phantom and cutaway, of the prior device electric strike as mounted in a door header and keeper engaged with a latch in the top of a door stile.

FIG. 9 is a side cutaway view of a prior device 1 shown mounted in a door header 9 with a keeper 3 engaging a latch 13 mounted in a door 10 in the closed and locked position. The illustration also shows the relocking lever 3B in alignment with the doorstop 9A.

Figure 10:
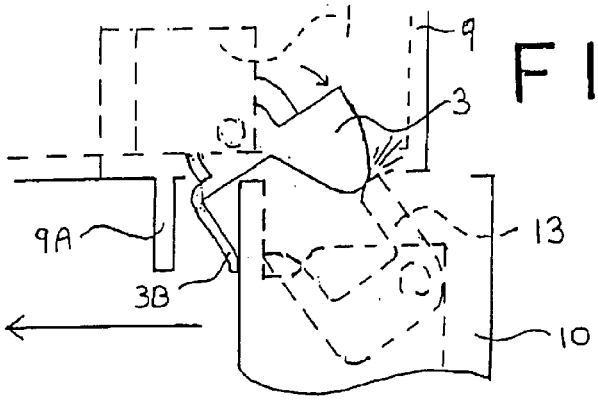
FIG. 10 (prior art) is a side view of the prior device strike of FIG. 9 in the released position and its keeper hitting the latch as the door is returning to its closed position.

FIG. 10 shows a condition that occurs when the prior device strike is in the unlocked position and the door is closing after the exit device had been activated. The lobe of the prior device keeper 3 comes into contact with the latch and causes enough friction to hold the door open and unsecured.

Figure 11:
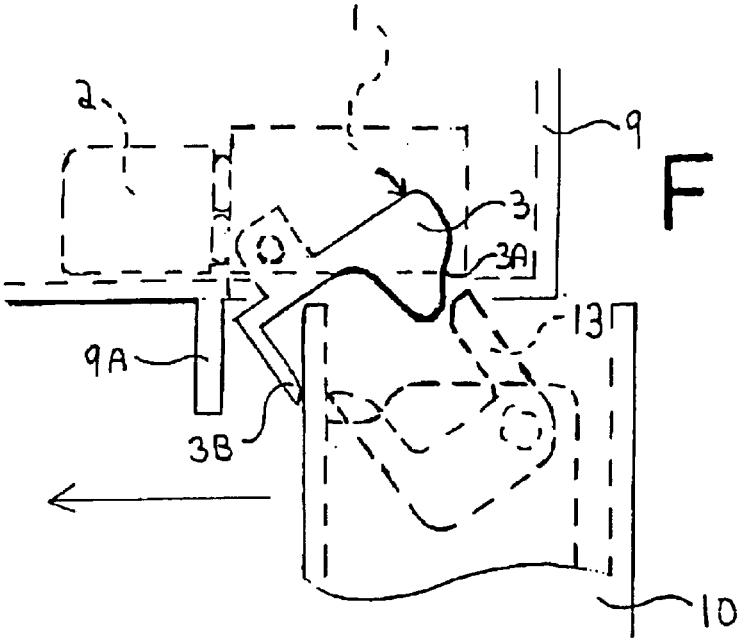
FIG. 11 is a side view, partially in phantom and cutaway, of the preferred embodiment of the invention as mounted in a door header in the released position as the door is about to close.

FIG. 11 is a side cutaway view of the preferred embodiment of the present invention having the strike 1 mounted in a door header 9 and showing the keeper 3 as it begins to engage a latch 13 mounted in a door 10 which is closing. The keeper's relocking lever 3B comes into contact with the inside edge of the door 10 and starts the keeper to rotate about its axle 1E toward its locked position.

Figure 12:
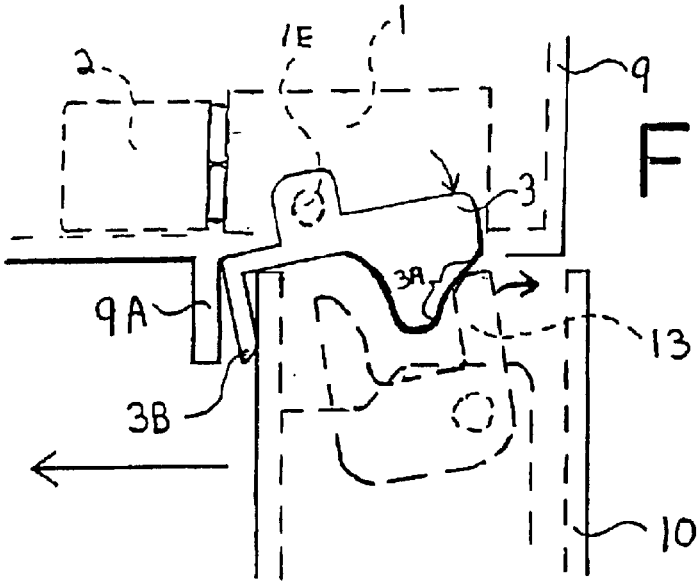
FIG. 12 is a side view of the electric strike of FIG. 11 as the contour of the keeper urges the latch in the top of the door stile to rotate back to its locked position.
Figure 13:
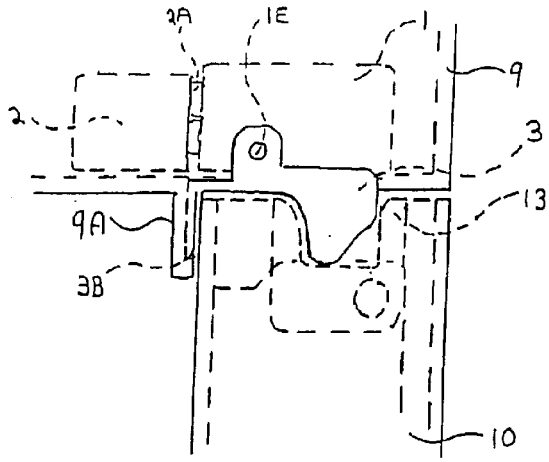
FIG. 13 is a side view of the electric strike of FIG. 11 at rest with the keeper engaged within the latch with the door in its fully closed position.

At the point where the keeper rotates and comes into contact with the latch (FIG. 12), the concave contour 3A on the lobe allows the keeper to enter the latch 13 and ramps out the latch 13 towards its locked position as it rotates. When the door fully closes (FIG. 13) and the keeper 3 is fully rotated back to its locked position, the door latch 13 has also been fully rotated back to its locked position and the door is secured.

Figure 14:
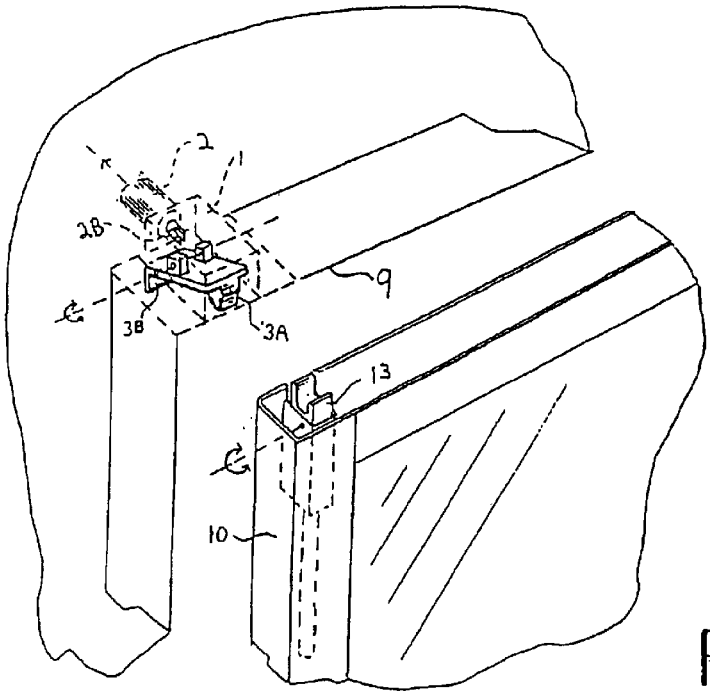
FIG. 14 is a perspective and cutaway view of the preferred embodiment of the invention mounted in a door header and a door as it relates to the invention.

FIG. 14 is a perspective cutaway view showing the relationship of the door 10, latch 13, header 9, and strike 1, 2, 2B mounted in the header with the keeper 3, 3A, 3B. The keeper is in the rotated (biased) or unlocked position as it would be after the solenoid 2, 2A had been energized and the door had been released by the strike and opened by a user.

Figure 15:
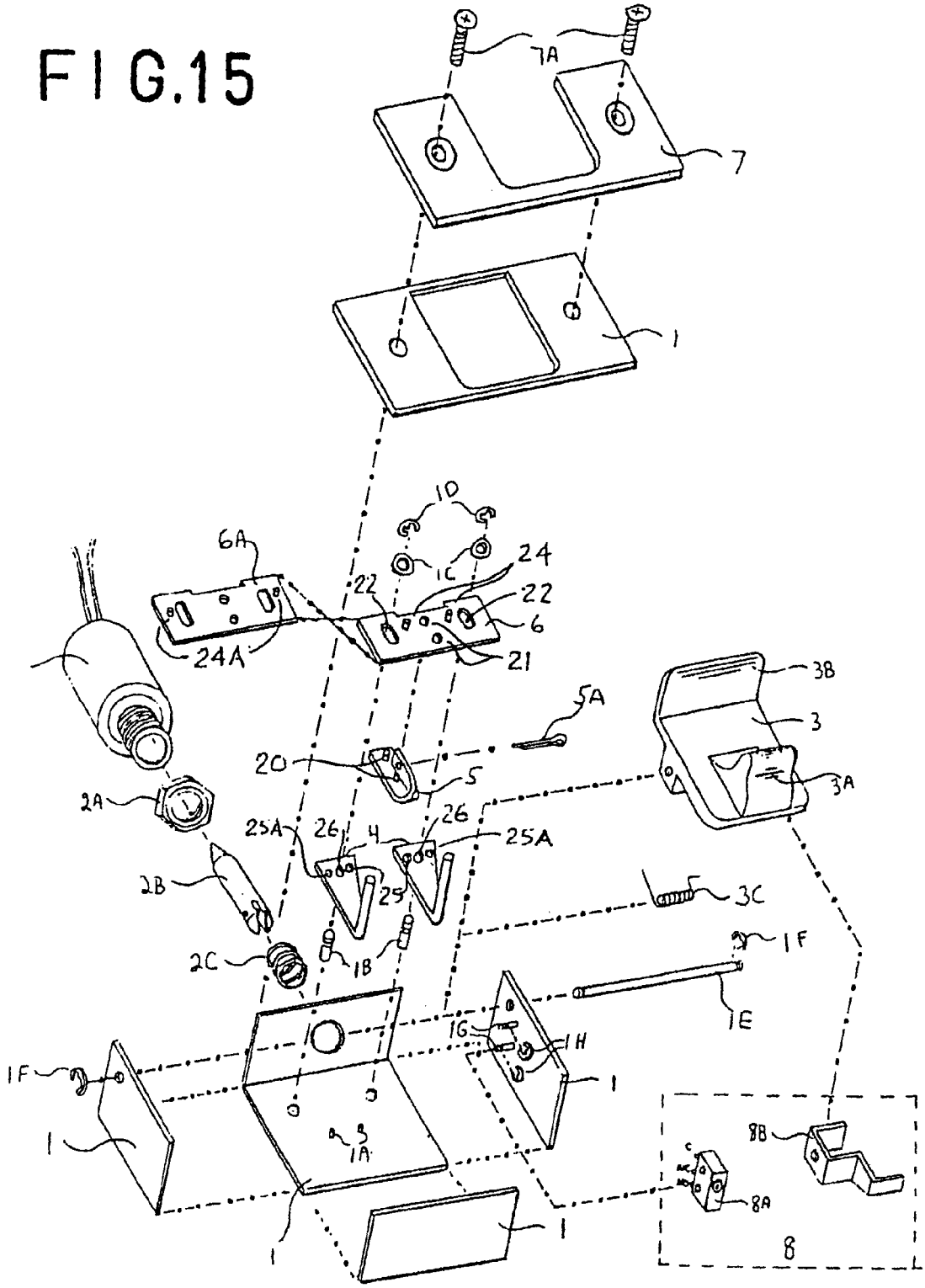
FIG. 15 is an expanded view of the parts of the preferred embodiment of the invention as seen in FIG. 1 through FIG. 13.

FIG. 15 is an exploded perspective view of the component parts of the preferred embodiment, which illustrates the different location of the drive, pins on the two sides of the actuator plate 6 and 6A. The view also shows the three holes in the locking bolts 4: the center hole being the pivot hole; and the two outer holes to accommodate the drive pins on either side of the actuator plate 6. The parts in the group identified by number 8 are the parts that would comprise a latch bolt monitoring option.

Figure 16:
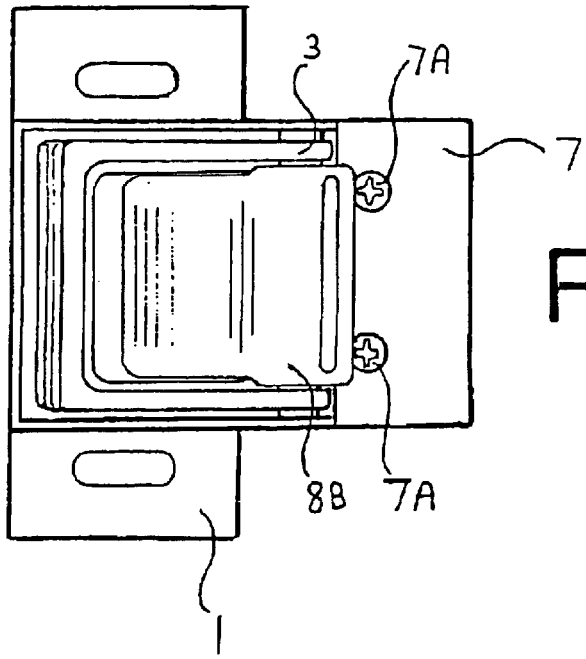
FIG. 16 is a side view of another embodiment of the invention, known as a rim panic strike, because it interacts with a rim panic bar or exit device.

FIG. 16 is a side view of the rim panic strike embodiment of the invention showing the mounting hole configuration of the body 1, the keeper 3 and the latch bolt monitoring sensor plate 8B as it sits inside the keeper.

Figure 17:
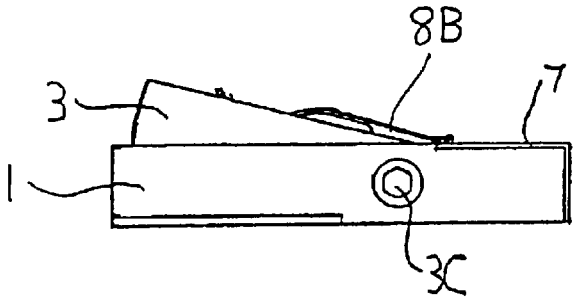
FIG. 17 is a top view of the rim panic strike.

FIG. 17 is a top view of the invention of FIG. 16 which shows the actual thickness of the strike, the keeper 3 as it extends out of the strike body 1, the keeper pivots 3C, the latch bolt monitoring sensor plate 8B and the cover 7.

Figure 18:
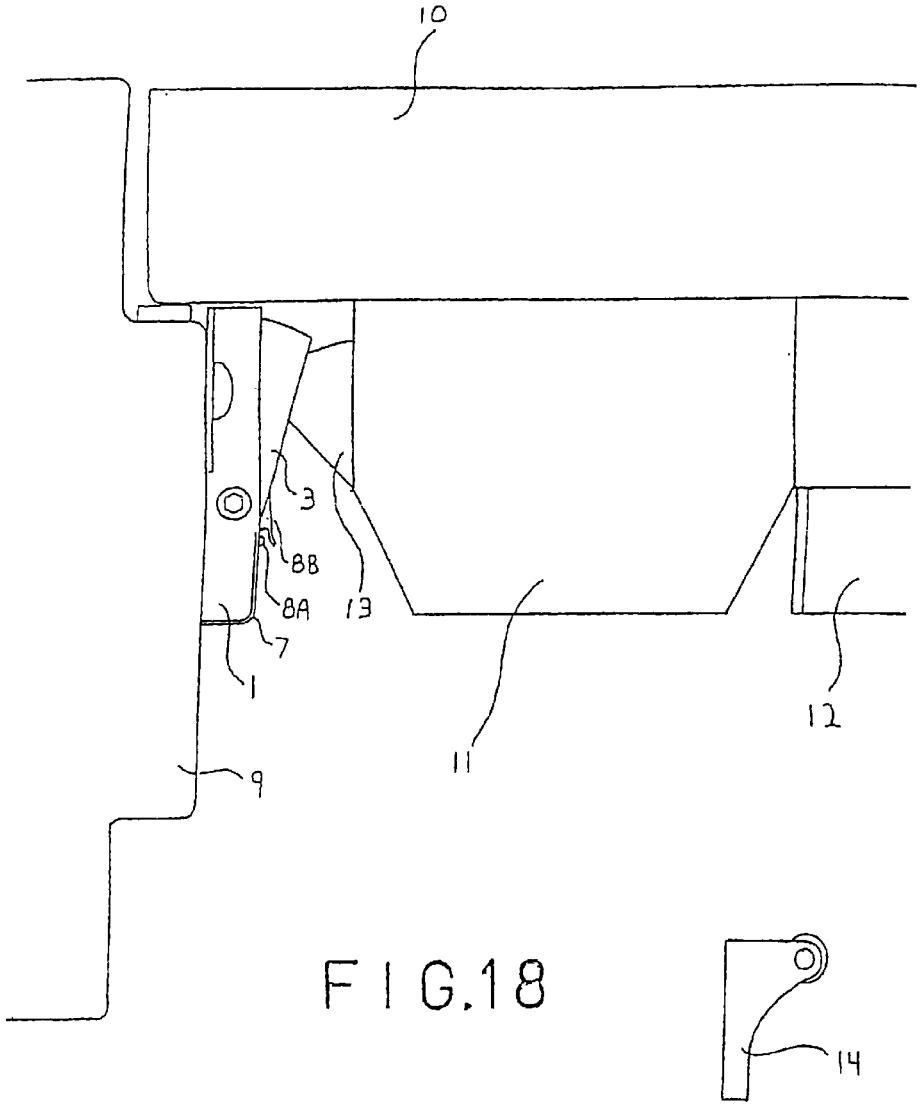
FIG. 18 is a top view of the electric strike of FIG. 16 mounted on a door frame and holding the latch of a rim mounted exit device mounted on a door.

FIG. 18 is a top view of the strike of FIG. 16 mounted in typical fashion on a door jamb 9 and holding the latch 13 of an exit device 11 with its push bar 12 mounted on a door 10. The standard roller latch 14 is shown (removed) as a reference.

Figure 19:
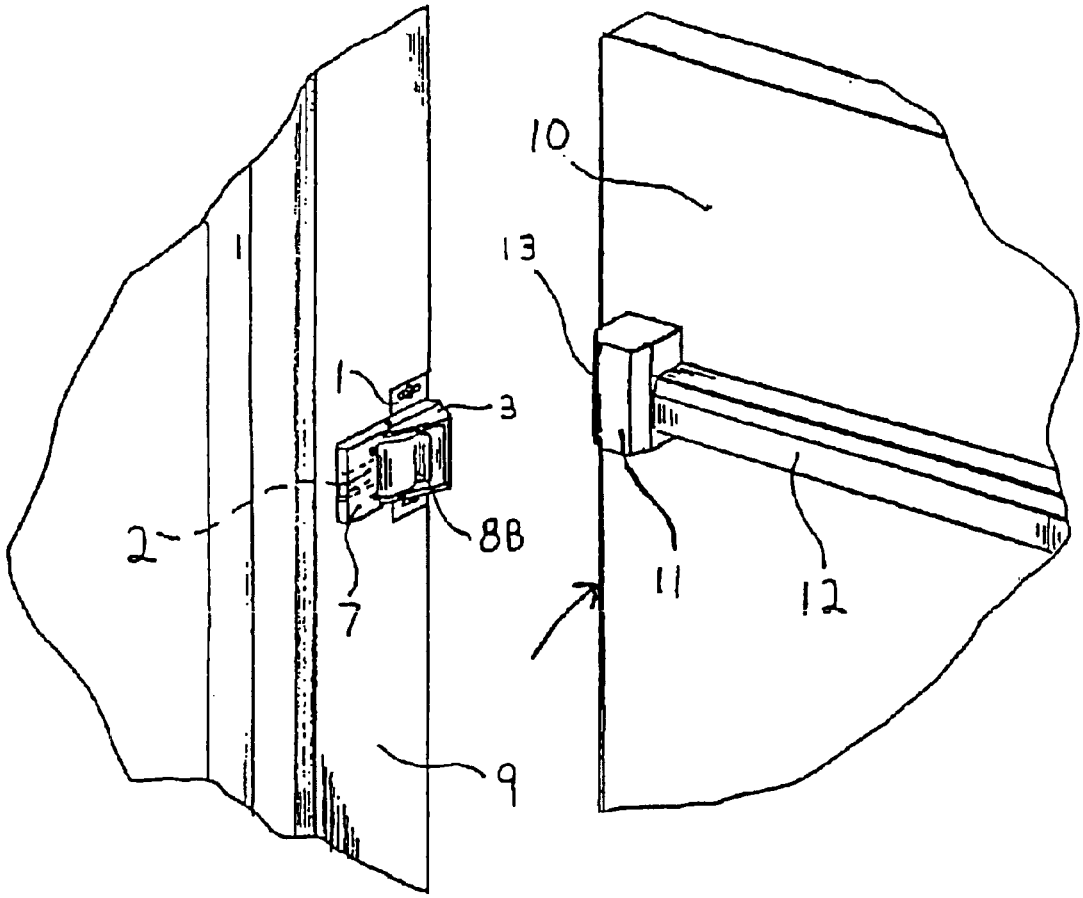
FIG. 19 is a perspective and cutaway view of the rim panic strike mounted on a door frame and a door with an exit device just after the strike has released the door.

FIG. 19 is a perspective cutaway view of the invention as seen in FIG. 18 showing the door after being released from the strike.

Figure 20:
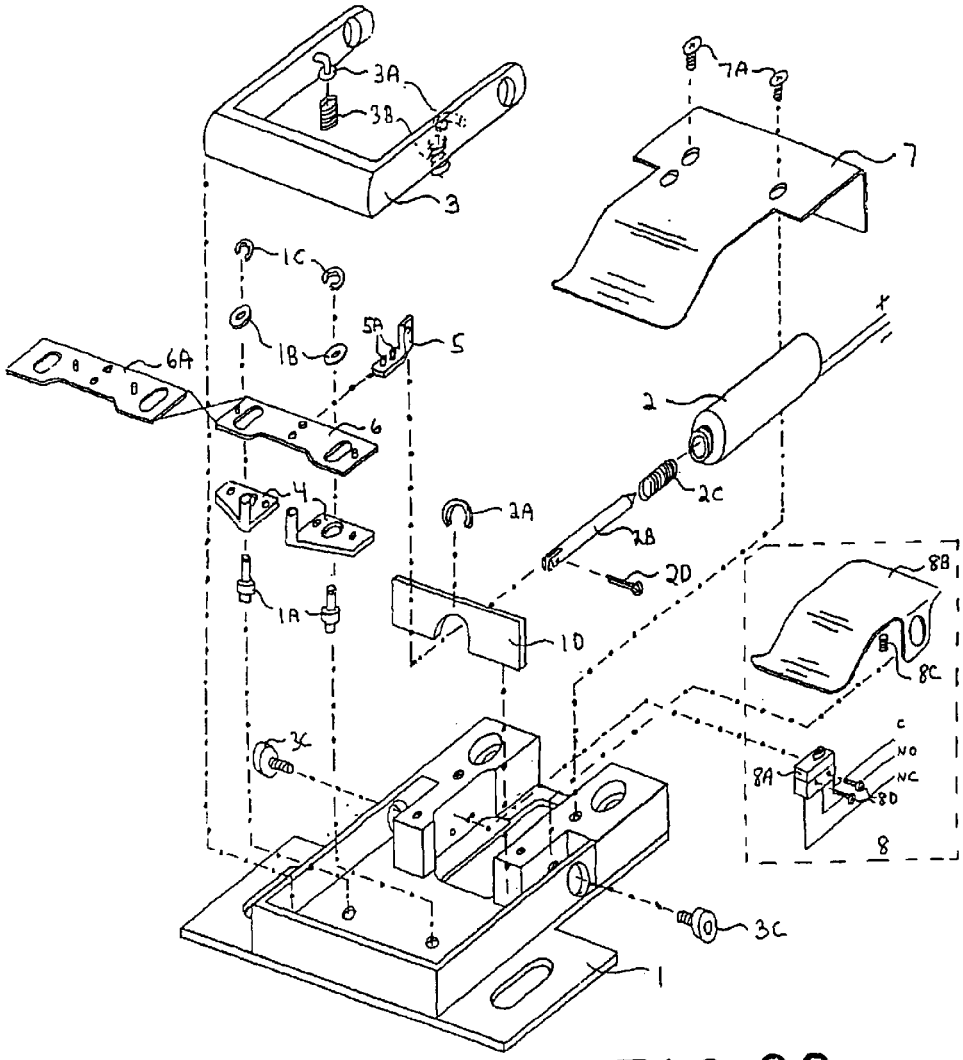
FIG. 20 is an expanded view of the parts of the electric strike of FIG. 16.

FIG. 20 is a perspective blow up view of the rim panic strike embodiment of the invention. The actuator plate 6, 6A is similar to the preferred embodiment, but the locking bolts plate 4 are shaped differently to accommodate the different keeper 3 design. The keeper assembly 3A, 3B, actuator arm 5 and locator pins SA, latch bolt monitoring assembly 8, solenoid assembly 2, 2A, 2B, 2C, strike body 1, and cover 7 are all different as well in this embodiment, but are functionally equivalent to the elements of the preferred embodiment.

Figure 21:
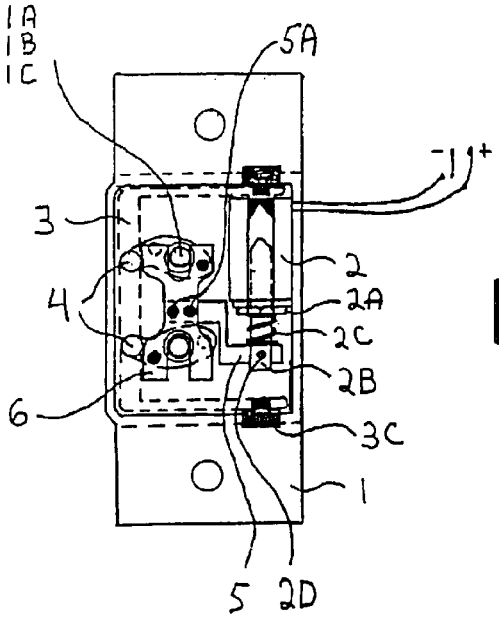
FIG. 21 is face view of the "T" strike embodiment without the face plate and showing a cutaway view of the internal parts of the strike in the fail-secure configuration at rest condition.

FIG. 21 shows a third embodiment in the form of a small format 161 prep, "T" strike and/or a larger ANSI format electric strike. This diagram illustrates the changes in the shape of the aforementioned component parts and their relational position to each other. The features and operation of the parts are functionally equivalent to the preferred embodiment. This view details the strike body 1 as it contains the relevant parts: solenoid assembly 2, 2A, 2B, 2C which is comprised of the solenoid housing and coil 2 the fastener 2A the plunger 2B the plunger spring 2C; the keeper 3 in dotted lines to reveal the position of the locking bolts beneath and its two pivots 3C; the locking bolts 4; the actuator 5 and locator pins 5A; and the actuator plate 6. This figure shows the strike at rest in the fail-secure configuration (locked).

Figure 22:
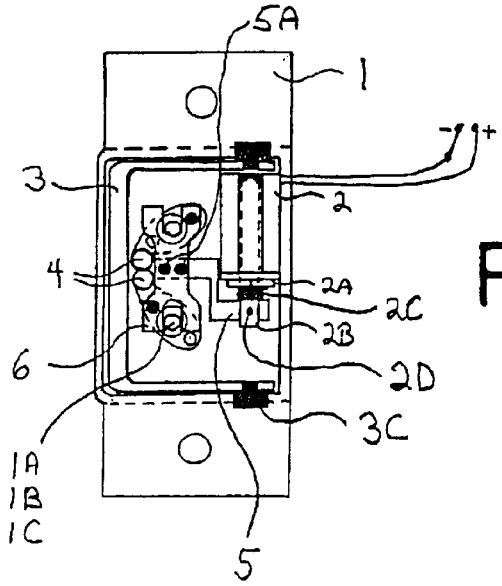
FIG. 22 is the same strike shown in FIG. 21, however, in the energized and unlocked condition.

FIG. 22 shows the same strike of FIG. 21 in the energized state (unlocked). This condition occurs when an electric current is applied to the leads of the solenoid 2. Electromagnetic force urges the plunger 2B toward the body of the solenoid 2 against the force of the return spring 2C and causes linear movement of the actuator 5 by means of a connecting pin 2D. This linear movement is translated to the actuator plate 6 by means of the locator pins 5A fitting into the holes in the actuator plate 6, causing it to slide against the pivots 1A. The linear movement of the actuator plate is translated into equal and opposite moments of torque exerted upon the two locking bolts 4 by the drive pins in the actuator plate 6 as they rotate in holes in the locking bolts 4. This rotation results in the keeper being free to be pushed into the body of the strike and out of the way of the latch as the door is pulled open by the authorized individual's hand. After the latch passes by the keeper 3, and after an appointed time, usually 5 seconds, the electric current is terminated by the access control computer and the keeper returns to its locked condition by the keeper springs 3A. This allows the locking bolts 4 to rotate back under the keeper as urged by the plunger spring 2C through the actuator 5 and actuator plate 6. The length of its slots limits the travel of the actuator plate 6 as it moves over the pivots 1A. Because it is loosely held in place by the pivot washers 1B and retainer clips 1C, the actuator 5 is captured under the actuator plate 6. When the user needs to change to the fail-safe configuration, the actuator plate 6 is flipped over and re-secured by the plate washers 1B and clips 1C. A second and opposite set of drive pins on the actuator plate 6 is introduced into a second and oppositely located set of holes in the locking bolts. This results in equal and opposite moments of torque exerted on the locking bolts as they rotate about the pivots 1A, and thereby, results in the opposite rest and rotated position of the locking bolts while the solenoid is energized.

Figure 23:
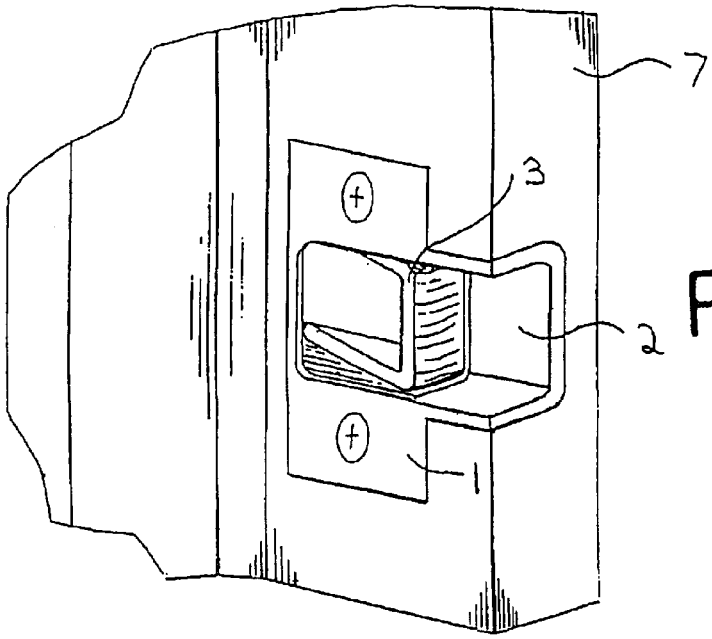
FIG. 23 is a perspective view of a prior strike mounted in a door jamb showing the "raceway" cutout and face plate.
Figure 24:
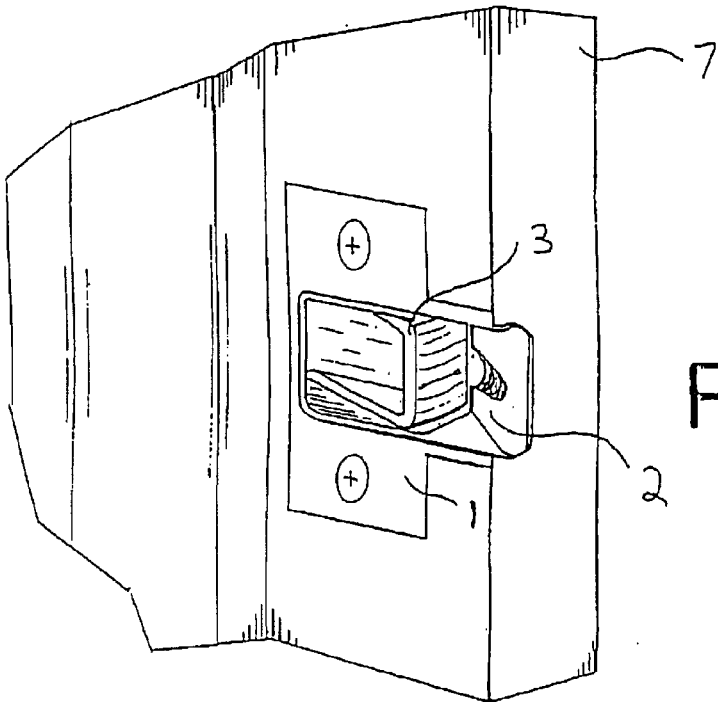
FIG. 24 is a perspective view of the "T" strike embodiment of the invention with the ramping faceplate that eliminates the "raceway" cutout.

FIG. 23 and FIG. 24 are perspective drawings that show the difference between the prior device and faceplate and the present invention and the ramping faceplate. It should be noted on FIG. 24 the scalloped out section on the ramp 2. This channel allows the auxiliary latch to fully extend after the latch passes over the keeper 3. Once both the auxiliary latch and main latches have fully extended, they will ramp in together and ride over the lip of the strike, clear the jamb altogether, and allow the door to fully open.

Figure 25:
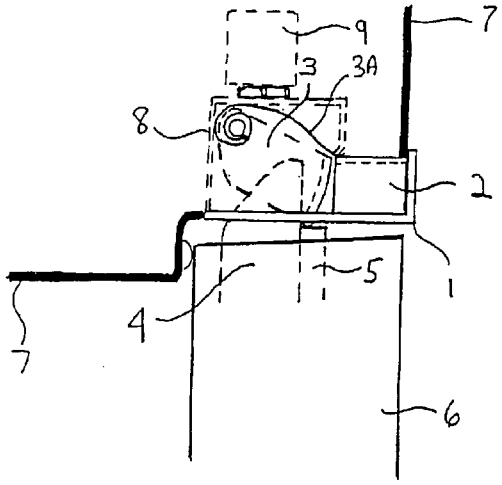
FIG. 25 is a top cutaway view of a prior strike mounted in a hollow metal door frame engaging a door latch behind the keeper (the view shows the "raceway" needed for the passage of the latch and the extra space required for the external solenoid)
Figure 26:
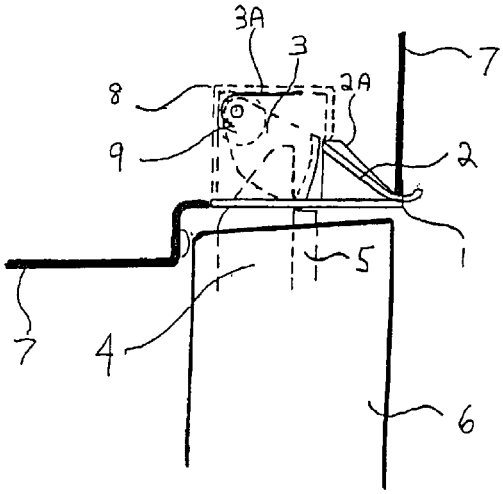
FIG. 26 is a top cutaway view of the "T" strike embodiment of the invention with the ramping faceplate and the smaller profile.

FIG. 25 and FIG. 26 show the same objects of FIG. 23 and FIG. 24, but show them in a top phantom and cutaway view.

These various embodiments come within the scope of the present invention. The inventor's preferred embodiments, which are described in detail herein, are exemplary of all possible embodiments which practice the spirit of the present invention. The discussion of these specific embodiments should not be construed as limiting the scope of the appended claims. For example, the invention could be made having a dedicated configuration, rather than being made to be field configurable. In view of this, it is understood that the above description is illustrative rather than limiting.

Similarly, although the preferred embodiment has a pair of locking elements such as the locking bolts, it should be appreciated that the principle of the invention could be applied to embodiments in which there is only one pivoting locking element which pivots behind or away from the keeper.

What is claimed is:

1. An electric strike mechanism for mounting in the header or jamb of a doorway to engage a door and selectively secure or release same, comprising:

a housing;

a keeper pivotally mounted in said housing for rotation about an axis parallel to an outer face of said housing, between a door-engaging position and a door-releasing position;

a first locking element and a second locking element, each of the first locking element and the second locking element being pivotally mounted within said housing for pivoting between a first position where said keeper is prevented from pivoting and a second position where said keeper is permitted to pivot, wherein when said first locking element and said second locking element pivot from said first position to said second position, a direction of movement of said first locking element is substantially parallel to a direction of movement of said second locking member;

a solenoid connected to each said locking element via an actuation means to move each said locking element when said solenoid is energized; and a spring biasing said solenoid towards a non-actuated position;

wherein said actuation means may be installed in one of two orientations, namely a first orientation wherein said first locking element and said second locking element are in said first position when said solenoid is not energized and wherein energizing said solenoid moves said first locking element and said second locking element to said second position, and a second orientation wherein said first locking element and said second locking element are in said second position when said solenoid is not energized and wherein energizing said solenoid moves said first locking element and said second locking element to said first position.

2. The electric strike mechanism of claim 1, wherein each of the first locking element and the second locking element are pivotable in opposite directions towards and away from each other between said first position and said second position respectively.

3. The electric strike mechanism of claim 2, wherein said actuation means comprises an actuator plate connected to said solenoid, said actuator plate having a first pair of pins extending from one side thereof and a second pair of pins extending from the opposite side thereof, said pins engaging holes in pivotally mounted plates carrying said locking elements to pivot said plates and locking elements about pivot pins, said first pair of pins spaced outwardly of said pivot pins and said second pair of pins spaced inwardly of said pivot pins to engage corresponding holes outward or inward of said pivot pins, whereby actuation of said solenoid produces different directions of pivoting of said plates and locking elements depending on installed orientation of said actuator plate and accordingly which pairs of pins engage which holes in said pivotally mounted locking plates.

4. An electric strike mechanism for mounting in the header or jamb of a doorway to engage a door and secure the door while permitting the door to open when the strike mechanism is electrically actuated, such mechanism comprising:

a. a rectangular shaped housing elongated along an axis for fitting into a recess in said header and having an external wall oriented therealong and a bottom section which serves as the base from which the stop means are supported;

b. a keeper body having flat surface with a prominent cam shaped lobe centered on one end and a thin raised section along the edge of the other end, said keeper mounted to rotate about an axis perpendicular to the length of said keeper, this axis being two thirds of the way down the length of said keeper from the lobe side and on an inner surface and through an axle connected to said rectangular shaped housing; the axle maintaining a spring wound around itself which is pre-loaded to apply a moment of torque between the keeper and the housing which biases the lobe end of the keeper to rotate into the housing; the axle also locates a bent metal finger to an axle hub which moves with the rotation of the keeper so as to operate an electrical switch mounted on two pins protruding from the inside wall of said housing; the inner surface of said keeper is flat (except where the axle hubs protrude) and parallel with the outer surface of said keeper;

c. a pair of locking bolts for holding the keeper, each of which consist of a flat isosceles triangle shaped plate with a solid cylindrical post mounted in a perpendicular fashion at the long end of the triangle, each of which rotates about its own axle mounted in said base in a perpendicular axis to said base and having equal and opposite rotation to each other;

d. an actuator plate which slides over both the said locking bolts in a bilateral motion having one side of the actuator with drive pins that are outside of the mounting pivot slots and the other side of the actuator has drive pins that are inside of the pivot slots; the locking bolts have holes equidistant on either side of the hole for the pivot and can be operated by either set of drive pins on the actuator plate, this resulting in the locking bolts rotating either toward each other or away from each other depending on which side of the actuator is facing the locking bolts;

e. an actuator arm connected to the actuator plate having locator pins which engage the actuator plate regardless of which side is up and connects with the end of a plunger, by means of a pin, which moves in like motion with the actuator into and out of a solenoid by electromagnetic force opposed by a coil spring which is located around the plunger between the arm and the solenoid; the solenoid is mounted in a threaded hole in the long side of the housing.

* * * * *